United States Patent [19]

Daspit

[11] Patent Number: 5,014,782

[45] Date of Patent: May 14, 1991

[54] VENTING PACKER

[76] Inventor: Ronald A. Daspit, 1301 E. Genie St., Chalmette, La. 70043

[21] Appl. No.: 472,257

[22] Filed: Jan. 30, 1990

[51] Int. Cl.[5] ..... E21B 33/126; E21B 33/129

[52] U.S. Cl. ..... 166/120; 166/122; 166/134; 166/140

[58] Field of Search ..... 166/140, 118, 120, 122, 166/134, 187, 212, 217; 138/89, 93

[56] References Cited

U.S. PATENT DOCUMENTS

| | | | |
|---|---|---|---|
| 2,338,326 | 1/1944 | Green | 166/140 |
| 2,812,822 | 11/1957 | O'Reilly | 166/187 |
| 2,813,588 | 11/1957 | O'Reilly | 166/187 |
| 2,854,080 | 9/1958 | Dale et al. | 166/140 |
| 3,039,533 | 6/1962 | Lacey | 166/120 |
| 3,135,327 | 6/1964 | Hanes | 166/120 |
| 3,142,338 | 7/1964 | Brown | 166/120 |
| 3,298,440 | 1/1967 | Current | 166/134 |
| 4,665,992 | 5/1987 | Franc | 166/122 |

*Primary Examiner*—Bruce M. Kisliuk
*Attorney, Agent, or Firm*—William H. Maxwell

[57] ABSTRACT

A venting packer tool for insertion into the open end of a pipe under repair and the like, characterized by telescoping body members hydraulically actuated to simultaneously operate an anchor to grip within the pipe and a packer to seal within the pipe, the body members having open communicating bores from the pipe interior to a vent tube for remote venting, and the tool inherently precluding accidental release when once set.

16 Claims, 1 Drawing Sheet

VENTING PACKER

BACKGROUND OF THE INVENTION

This invention relates to a venting packer from which a vent pipe or tube extends so as to direct fluids away from piping where said fluids are unwanted. A typical situation is in a work area where flammable gas from piping apparatus is a dangerous hazard during repair or building and installation proceedures. For example, a section of pipe is often in need of repair or replacement, or additional apparatus is to be secured or welded into existant apparatus that has residual fluids therein. Such fluids are liquids and gases that are combustible and/or volatile, and such as to be ignited by flames or sparks generated during normal work proceedure. The dispositions of pipe sections and the surrounding environment will vary, and the work area will occur in the open or in confined spaces exposed to other potentially dangerous operations; and in such places as excavations and in under water installations. It is the isolation of combustible and/or explosive fluids with which this invention is primarily concerned, it being a general object to provide an extremely simple and practical venting packer that is reliable and readily adapted to a multitude of situations that require the assurance of safe working conditions, without failure.

Packers have been widely used in the oil field, and positioned within well casings and the like in order to perform various procedures. And, slips have been used to anchor the packers in position; also referred to as "anchor-packers". The principle of operation has been to expand both the slips and the packers, the former to anchor within the casings, and the latter to plug the casing or to shut off an annulus therein. A feature of packers is the ability to direct the flow of fluid therethrough, for whatever purpose may be required. However, combined anchor-packers of the prior art have been complicated by the particular task they perform, and are not reduced to simple practicality, it being an object of this invention to provide a venting anchor-packer that is reduced to its basic simple practicality and having an inherent mode of operation which is essentially fail-safe. That is, its effective operation can be relied upon without fail, there being no complexity subject to malfunction.

It is an object of this invention to provide a venting anchor-packer that is of plug form through which flow can occur while sealing off an extended annulus in a surrounding pipe, tube or casing. In the field, there are many situations where pipes are in need of repair or adaptation to or removal of other equipment. And, access to the area of repair is either upstream or downstream of a fluid source; in many cases a dangerous fluid. Accordingly, repair can be safely accomplished only by isolation from said dangerous fluid, and with this invention by plugging off the source of dangerous fluid and venting it away from the work area. In practice, a vent tube is attached to one body element of this plug device, to carry off the unwanted fluid, for example a flammable gas.

It is another object of this invention to provide a plug device that simultaneously anchors and packs by the direct application of mechanical forces from a single expansible slip member carried by the aforesaid one body member to which the vent tube is attached. A feature of this invention is the sectional body comprised of the aforesaid one body member in the form of a first cylinder member and a second piston member that carries expansible packer elements expanded by the aforesaid expansible slip member. A feature is the direct double function of the expansible slip member, that anchors and operates the packer elements.

It is still another object of this invention to provide a body and packer element combination that operates the slip element that retroactively operates the packer elements. There is no intervening mechanism, the slip element being shifted axially so as to expand radially. A feature of this invention is the telescoping first and second body members of this plug body that establishes an annular cylinder and through which the packed off fluid is vented into and through the vent tube. One of the body members is connected to a fluid pressure line for drawing the body members together, preferably to the movable piston member to transmit hydraulic liquid under suitable operating pressure.

It is an object of this invention to provide a fail-safe feature, in that the slips will not release under normal conditions even though there is a temporary loss of operating pressure in the hydraulic line. There is an unobvious feature provided by facing the slip wedge angle upwardly, while the opposed body wedge angle is faced downwardly to support the weight of the upstanding vent tube. In practice, radial expansion of the slip member is small and the wedge angles acute, so that weight of the vent tube applied to the frictional engagement of the slip and one body member prevents unintended release. Only by removal of vent tube weight and by deliberate lifting and/or jarring action can the slip member collapse for removal of this venting anchor-packer.

SUMMARY OF THE INVENTION

Repair of piping is often conducted where flammable gases occur in the work area. Since repair procedures involve welding, flame and spark producing processes, it is imparative that the work area be purged of said gases. Closing off the source and/or purging of the pipe system in the work area is not always possible, nor may it be feasible. Accordingly, the gas source or any residual thereof is to be vented away as a precaution against an otherwise immanent fire or explosion. For example, a system can be shut down yet it may continue to discharge a substantial volume of gas that would be dangerous. Accordingly, the work area is plugged or packed off and the residual gas in the system is vented from the work area, so that pressure cannot build up in the system, and so that the gas by passes the work area. In accordance with this invention there is a telescoped body comprised of cylinder and piston members, over which there is a slip member and packing elements operated through the application of hydraulic pressure. A vent passage is ducted through the body members, there being a vent tube extending from the body to carry off any gas source emanating from the pipe system.

The foregoing and various other objects and features of this invention will be apparent and fully understood from the following detailed description of the typical preferred form and application thereof, throughout which description reference is made to the accompanying drawings.

THE DRAWINGS

PREFERRED EMBODIMENT

Figure 2:
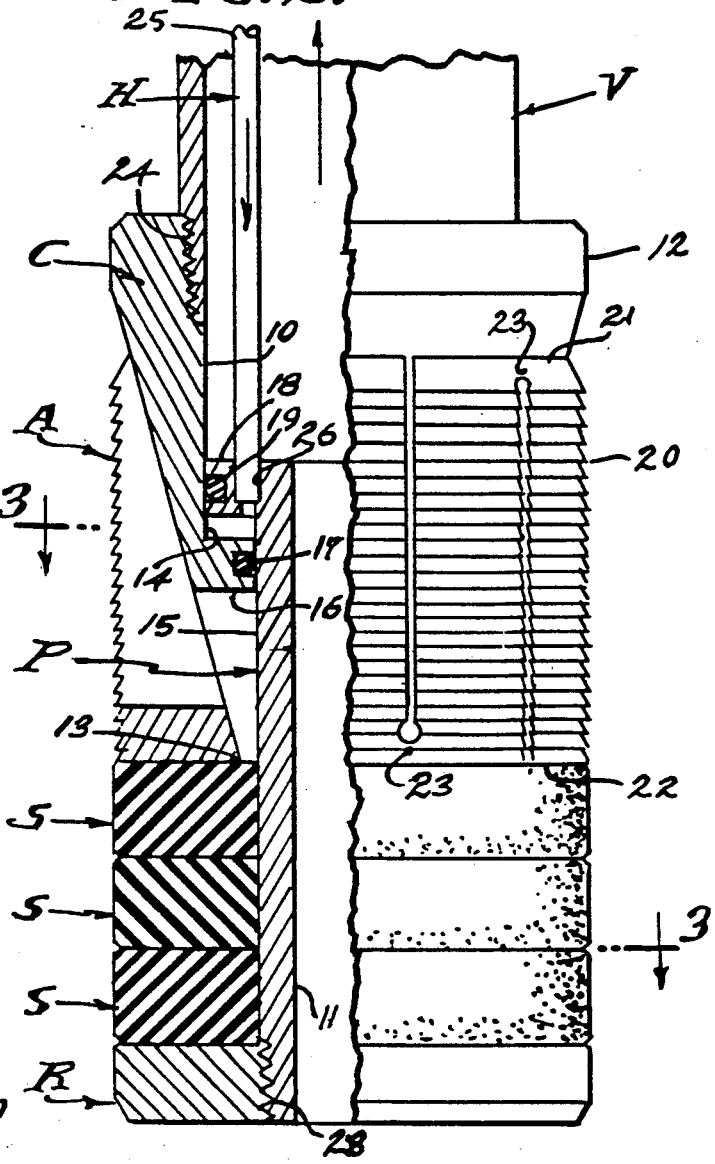
FIG. 2 is an enlarged detailed view, in section to the left of the centerline and in elevation to the right of the centerline.
Figure 3:
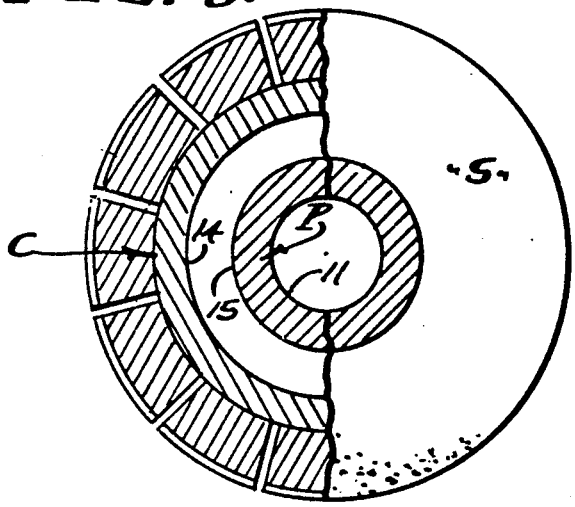
FIG. 3 is a transverse section view taken as indicated by line 3—3 on FIG. 2.

Referring now to the drawings, the venting anchor-packer in its basic simple form involves generally, a body comprised of telescopically related sections in the form of a cylinder member C and a piston member P coaxially related so as to collapse one into the other through applied hydraulic force, an expansible anchor element A carried by the cylinder member, and an expansible packer element 5 carried by the piston member. Each member and element is a simple turned or circular part, the cylinder member C being extended by a vent tube V through which a hydraulic line extends for remote operation, and the anchor element A and packer element S being captured on the cylinder member and piston member respectively, by a retainer ring R. The body cylinder member C is characterized by a stepped bore that extends therethrough, there being a bore 10 through the member for venting and in open communication with a bore 11 through the piston member P, also for venting. As shown, one body member telescopes within the other, so as to be extended in an unactuated condition as shown in FIG. 2.

The body cylinder member C is turned to a top diameter 12 slightly less than the pipe bore into which this device or tool is to be inserted, and it is characterized by a male form having a downwardly and inwardly tapered exterior of cone shaped configuration having an outside bottom diameter 13 substantially larger than a tubular extension 15 of the body piston member P. As shown, the cylinder member C has an inner cylinder diameter 14 greater than that of the piston extension 15, leaving an effective cylinder annulus therebetween, there being an inturned flange 16 from diameter 14 with a seal 17 to engage the projecting extension 15. Thus, the bottom of the cylinder annulus is closed.

The body piston member P is of right cylinder form establishing the tubular extension 15 slidably projecting through the flange 16 of the body cylinder member C and sealed therewith by the seal 17. As shown, the piston member P has an outer exterior diameter (15) lesser than that of the cylinder diameter 14, leaving the effective cylinder annulus therebetween, there being an outturned flange 18 from the diameter 15 with a seal 19 to engage the cylinder bore diameter 14. Thus, the top of the cylinder annulus is closed.

In accordance with this invention, the body members C and P are hooked together when telescopically related as shown in the drawings, all without superfluous fastening. And, the bores 10 and 11 remain in open communication, while the body members C and P are guided by the turned inner and outer diameters of the flanges 16 and 18.

The expansible anchor member A is a sleeve of collet configuration, and it is characteristically of female form having an upwardly and outwardly tapered interior of cone shaped configuration that is complementary to the exterior cone shape of the body cylinder member C. The outer surface of the anchor member a is coextensively turned to a diameter slightly less than the pipe bore into which it is to be inserted to engage, and it is provided therefore with a gripping means, preferably rows of horizontally disposed downardly faced teeth 20 coextensively from top to bottom thereof. The anchor member A is of right cylinder form having normal top and bottom ends 21 and 22. The anchor member A is characterized by its interlaced segments, expansion being established by means of splitting its sleeve form into slip segments joined at alternate top and bottom ends by resilient hinge connectors 23, whereby they separate circumferentially as a result of being expanded radially. The individual slip segments are integrally joined by said upper and lower, top and bottom, connectors 23, as is clearly shown.

The segmented anchor member A is capable of substantial expansion and memory for return to its initial form as shown, for example several tenths of an inch in a nominal four inch diameter. This range of expansion makes possible universal accomodation to the varied scheduled and types of pipe and tubing encountered in the work field. The sleeve of anchor member A is fabricated of a heat treated or tempered steel, such as a spring steel, whereby its teeth are sharply buried into the pipe wall for anchored gripping, and whereby the tapered cone faces are under radial pressure for frictional engagement that maintains a set condition until intentionally released. A feature is that the bottom end 22 presents a flat axially disposed face adapted to forceably engage the packing element S. In practice, there is a stack of packer seals as next described.

The expansible packer element S is at least one ring of substantially incompressible rubber or the like engaged closely between the bottom 22 of the anchor member A and an upwardly disposed face of the retainer ring R. The packer element, or elements, has an inner diameter slidable over the piston extension 15, and has an outer diameter slightly less than the pipe into which it is to be inserted and sealed. As shown, there is a plurality of packer elements S stacked between the bottom 22 and face of retainer ring R, to be forceably clamped axially so as to expand radially. Accordingly, the anchor member A has two forceful functions, one to expand radially, and the other to shift axially into releasable clamped engagement with the packer element or seal elements S.

The venting anchor-packer thus far described is a complete operable device or tool, secured together as a unit by the one retainer ring R. In practice, there is a single threaded joint at 28 that secures the entire assembly.

The vent tube V is coupled to the uppermost body cylinder ember C, to which it applies its weight, and for the primary purpose of being in open communication with the body bores 10 and 11. Accordingly, there is free fluid flow from below the device or tool. The vent tube V is essentially an upward continuation of the body cylinder member C, and a continuation of its bore 10. Tube V may be integral with member C, or preferably a separate part coupled to the body member as by a screw thread 24. Thus, a suitable vent tube V can be selected from each work situation, and coupled to the body cylinder member C as an extension of the device or tool.

Operation of this device or tool is by operating means forceably telescoping the two body members C and P together, that is to collapse them in order to simultaneously expand the anchor member A and packer element S. In practice, fluid means is employed to operate the cylinder and piston members C and P, preferably hydraulic means H. As shown, a hydraulic line 25 is coupled into the flange 18 and opens therethrough into the cylinder annulus. The line 25 may be a flexible hose or a rigid tubing, of small diameter, secured as by brazing into a socket 26. In practice, the vent tube V is of substantial length with the hydraulic line 25 coextensively carried therein for remote access through the tube wall or at the open end thereof, all as circumstances may require. Control is by suitable means applying and exhausting fluid pressure to and from the line 25.

Figure 1:
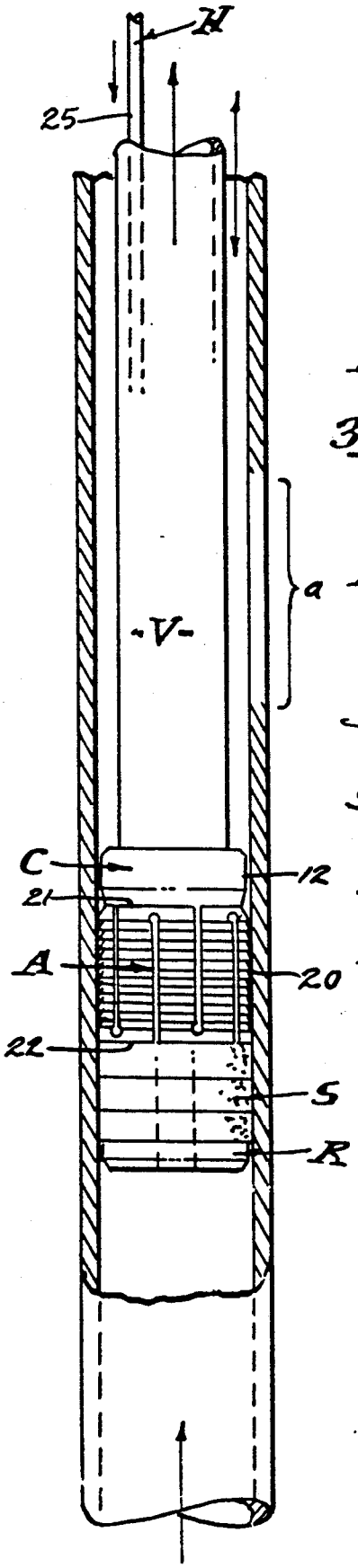
FIG. 1 is a sectional view taken through a pipe system work area to be repaired at a and showing the venting anchor-packer of the present invention in elevation.

Operation of this venting anchor-packer unit is as follows: The device or tool is assembled as hereinabove described and as clearly shown in the drawings. A suitable vent tube V is coupled to the body cylinder C and extended away from the work area, for example a defective area as indicated at a. The hydraulic line 25 is extended to a remote control means for the application of fluid pressure to telescopically collapse the body members C and P, whereby the retainer ring R lifts the packing elements S and anchor member A that are forceably shifted upwardly and outwardly on the cone shaped configuration of the body cylinder member C. The anchor teeth 20 are thereby expanded into engagement with the inner diameter wall of the pipe into which the device or tool has been inserted, as clearly shown in FIG. 1 of the drawings. When the anchor member A has been set, continued pressure and movement of the member P forceably clamps and compresses the seal elements S so that they expand into sealed engagement with the inner diameter wall of said pipe. The device or tool remains in position at the work area until hydraulic pressure is exhausted from the cylinder annulus. However, a feature of the invention is that inadvertent loss of hydraulic pressure does not release the device or tool, since the weight of the vent tube V applied through the downwardly tapered body cylinder member C is supported by the complementary upwardly tapered slips of the anchor member A. The cone and slip angle is acute and the weight applied such that release does not occur accidently. Only by deliberate withdrawal of the vent tube V and coupled body cylinder member C does the device or tool release from the pipe work area.

Having described only the typical preferred form and application of my invention, I do not wish to be limited or restricted to the specific details herein set forth, but wish to reserve to myself any modifications or variations that may appear to those skilled in the art as set forth within the limits of the following claims.

I claim:

1. A venting packer for releasable anchored and sealed engagement in a pipe and positioned to isolate fluids in the pipe from an open end thereof under work conditions, and including;

telescopically related body members having interconnecting bores, the bore of one body member opening toward said open end of the pipe and being extended by a vent tube, and the bore of the other body member being open away from said open end of the pipe and being in open communication with fluids within the pipe into which it is inserted, the two body members having inner and outer diameters separated by inwardly and outwardly turned flanges forming a cylinder and piston annulus therebetween, anchor means carried over said one body member to engageably grip an inner diameter wall of said pipe into which it is inserted, a packer element carried by said other body member to engageably seal the interconnecting bores against said fluid within the pipe into which it is inserted, and operating means including a fluid pressure line carried by and extending from the said other body member and opening into and exhausting from the cylinder and piston annulus and forceably shifting the body members relative to each other for simultaneous releasable actuation of the anchor means to engageably grip in the pipe and of the packer element to engageably seal in the pipe.

2. The venting packer for insertion into the open end of a pipe as set forth in claim 1, wherein the vent tube extends away from said one body member and to the open end of the pipe.

3. The venting packer for insertion into the open end of a pipe as set forth in claim 1, wherein a tubular extension of said other body member projects through the inwardly turned flange of said one body member to carry said packer element.

4. The venting packer for insertion into the open end of a pipe as set forth in claim 3, wherein the packer element is at least one substantially incompressible ring of a rubber material clamped axially by the shifting body members.

5. The venting packer for insertion into the open end of a pipe as set forth in claim 1, wherein a tubular extension of said other body member projects through the inwardly turned flange of said one body member to carry said packer element, there being a retaining ring fastened to the tubular extension in opposition to the anchor means and with the packer element clamped therebetween.

6. The venting packer for insertion into the open end of a pipe as set forth in claim 5, wherein the packer element is at least one substantially incompressible ring of a rubber material clamped axially by the shifting body members.

7. The venting packer for insertion into the open end of a pipe as set forth in claim 1, wherein the exterior of said one body member is of tapered cone shape, and wherein the anchor means is an expansible collet sleeve having an interior of complementary cone shape engageable with and shiftable axially of the tapered exterior of said one body member to be forceably expanded radially to engageably grip the inner diameter wall of said pipe.

8. The venting packer for insertion into the open end of a pipe as set forth in claim 7, wherein the expansible collet sleeve of the anchor means is split into separable segments.

9. The venting packer for insertion into the open end of a pipe as set forth in claim 7, wherein the expansible collet sleeve of the anchor means is split into separable segments joined circumferentially at alternate opposite ends thereof.

10. The venting packer for insertion into the open end of a pipe as set forth in claim 7, wherein the expansible collet sleeve of the anchor means is of resilient material split into separable segments integrally joined circumferentially by resilient spring connections at alternately opposite ends thereof.

11. The venting packer for insertion into the open end of a pipe as set forth in claim 7, wherein the cone shaped exterior of said one body member is downwardly and inwardly tapered, and wherein the interior of said collet sleeve is upwardly and outwardly tapered, whereby the weight of said one body member and extended tube prevents other than deliberate release of the anchor means.

12. The venting packer for insertion into the open end of a pipe as set forth in claim 7, wherein the expansible collet sleeve of the anchor means is split into separable segments, wherein the exterior of said one body member is of tapered cone shape, and wherein the anchor means is an expansible collet sleeve having an interior of complementary cone shape engageable with and shiftable axially of the tapered exterior of said one body member to be forceably expanded radially to engageably grip the inner diameter wall of said pipe.

13. The venting packer for insertion into the open end of a pipe as set forth in claim 7, wherein the expansible collet sleeve of the anchor means is split into separable segments joined circumferentially at alternate opposite ends thereof, wherein the exterior of said one body member is of tapered cone shape, and wherein the anchor means is an expansible collet sleeve having an interior of complementary cone shape engageable with and shiftable axially of the tapered exterior of said one body member to be forceably expanded radially to engageably grip the inner diameter wall of said pipe.

14. The venting packer for insertion into the open end of a pipe as set forth in claim 7, wherein the expansible collet sleeve of the anchor means is of resilient material split into separable segments integrally joined circumferentially by resilient hinge connections at alternately opposite ends thereof, wherein the exterior of said one body member is of tapered cone shape, and wherein the anchor means is an expansible collet sleeve having an interior of complementary cone shape engageable with and shiftable axially of the tapered exterior of said one body member to be forceably expanded radially to engageably grip the inner diameter wall of said pipe.

15. The venting packer for insertion into othe open end of a pipe as set forth in claim 7, wherein the expansible collet sleeve of the anchor means is split into separable segments joined circumferentially at alternate opposite ends thereof, and wherein the packer element is at least one substantially iincompressible ring of a rubber material clamped axially by the shifting body members.

16. The venting packer for insertion into the open end of a pipe as set forth in claim 1, wherein the packer element is at least one substantially incompressible ring of a rubber material clamped axially by the shifting body members.

* * * * *